US005478646A

United States Patent [19]

Asanuma et al.

[11] Patent Number: 5,478,646

[45] Date of Patent: Dec. 26, 1995

[54] POLYPROPYLENE FIBER AND A PREPARATION PROCESS THEREOF

[75] Inventors: Tadashi Asanuma, Takaishi; Tetsunosuke Shiomura, Tokyo; Shigeru Kimura; Nobutaka Uchikawa, both of Takaishi; Yoichi Kawai, Yokohama; Keigo Suehiro, Yokohama; Satoshi Fukushima, Yokohama, all of Japan

[73] Assignee: Mitsui Toatsu Chemicals, Inc., Tokyo, Japan

[21] Appl. No.: 15,056

[22] Filed: Feb. 8, 1993

Related U.S. Application Data

[63] Continuation of Ser. No. 562,841, Aug. 6, 1990, abandoned.

[30] Foreign Application Priority Data

Aug. 25, 1989 [JP] Japan ..... 1-217403
Aug. 25, 1989 [JP] Japan ..... 1-217404

[51] Int. Cl.[6] ..... D02G 3/00

[52] U.S. Cl. ..... 428/364; 428/373; 428/374

[58] Field of Search ..... 428/364, 373

[56] References Cited

U.S. PATENT DOCUMENTS

| | | | |
|---|---|---|---|
| 3,073,002 | 7/1963 | Munt | 428/364 X |
| 3,258,455 | 6/1966 | Natta | 260/93.7 |
| 3,268,627 | 8/1966 | Emrick | 260/597 |
| 3,305,538 | 2/1967 | Natta | 260/93.7 |
| 4,335,225 | 6/1982 | Collette | 526/154 X |
| 4,560,734 | 12/1985 | Fujishita et al. | 526/142 |
| 4,892,851 | 1/1990 | Ewen et al. | 526/160 |

FOREIGN PATENT DOCUMENTS

| | | |
|---|---|---|
| 0351391 | 1/1990 | European Pat. Off. . |
| 2127424 | 4/1984 | United Kingdom . |

OTHER PUBLICATIONS

J. Am. Chem. Soc. 1988, 110, pp. 6255–6256.

*Primary Examiner*—Patrick J. Ryan
*Assistant Examiner*—J. M. Gray
*Attorney, Agent, or Firm*—Burns, Doane, Swecker & Mathis

[57] ABSTRACT

A fiber excellent in strength and having an average size of 10,000–0.1 denier can be obtained by extruding a raw material composed mainly of a polypropylene having a syndiotactic pentad fraction of 0.7 or more and optionally stretching the resulting extruded material.

By using as the raw material a composition consisting of two kinds of polypropylenes each having an intrinsic viscosity $\eta_1$ or $\eta_2$, the $\log(\eta_2/\eta_1)$ being more than 0.05 or less than −0.05, and a syndiotactic pentad fraction of 0.7 or more at a weight ratio of 95:5–5:95 or a composition consisting of at least 50 parts by weight of a syndiotactic polypropylene having the intrinsic viscosity $\eta_1$ and a syndiotactic pentad fraction of 0.7 or above and at most 50 parts by weight of an isotactic polypropylene having the intrinsic viscosity $\eta_2$, the extrudability is improved and the fiber stretching conditions are broadened.

8 Claims, No Drawings

POLYPROPYLENE FIBER AND A PREPARATION PROCESS THEREOF

This application is a continuation of application Ser. No. 07/562,841, filed Aug. 6, 1990, now abandoned.

BACKGROUND OF THE INVENTION (i) Field of the Invention

This invention relates to a novel polypropylene fiber. More specifically, this invention relates to a polypropylene fiber with high syndiotacticity and a preparation process thereof.

(ii) Description of the Prior Art

Although the existence of syndiotactic polypropylenes has been known from old days, polypropylenes produced by the conventional process, in which propylene is polymerized at low temperatures in the presence of a catalyst comprising a vanadium compound, an ether and an organoalumihum, have been said to have elastomer-like characteristics. However, these polypropylenes are of low syndiotacticity and hence can hardly be regarded as syndiotactic polypropylenes. On the other hand, a polypropylene of good tacticity, say, a syndiotactic pentad fraction of more than 0.7, has been discovered for the first time by J. A. Ewen et al. by the use of a catalyst comprising a transition metal compound having an asymmetric ligand and an aluminoxane (J. Am. Chem. Soc., 1988, 110, 6255–6256).

On the other hand, one of the large uses of isotactic polypropylenes is for fibers, and they have been used as fibers having relatively good properties and strong chemical resistance. However, they are a little inferior in fiber strength and therefore polyolefin fibers improved in this point have been desired.

The present inventors have made intensive investigations into polyolefin fibers which are free from the above problem and hence are excellent in strength, and finally found that polypropylenes of high syndiotacticity are suitable for use as fibers, leading to completion of the present invention.

SUMMARY OF THE INVENTION

The object of the present invention is to provide a polyolefin fiber of excellent strength and a preparation process thereof.

The present invention provides a fiber with an average size of 10,000–0.1 denier formed by extruding a raw material composed mainly of a polypropylene having a syndiotactic pentad fraction of 0.7 or more and optionally stretching the resulting extruded material; and a preparation process of the aforesaid fiber comprising extruding a raw material composed mainly of a polypropylene having a syndiotactic pentad fraction of 0.7 or more and, if necessary, stretching the resulting extruded material.

DESCRIPTION OF THE PREFERRED EMBODIMENTS

In the present invention, the fiber raw material composed mainly of a polypropylene having a syndiotactic pentad fraction of 0.7 or more includes a polypropylene having a syndiotactic pentad fraction of 0.7 or more and a composition consisting of 50 parts by weight or more of such polypropylene and less than 50 parts by weight of an isotactic polypropylene.

The polypropylene having a syndiotactic pentad fraction of 0.7 or more useful in the practice of the present invention may include not only the homopolymer of propylene but also the copolymer of propylene with a small amount of other olefin such as ethylene, butene-1, pentene- 1, 4-methylpentene-1, hexene-1 and octene-1. The proportion of other olefin in the copolymer is generally 20% by weight or less, preferably 15% by weight or less. If the proportion exceeds 20% by weight, the strength of the resulting fiber will unfavorably be low. The syndiotactic pentad fraction is defined by A. Zambelli et al. in Macromolecules Vol. 6, 925 (1973) and ibid. Vol. 8, 687 (1975), and is obtained by analyzing the $^{13}$C-NMR spectrum measured with a 1,2,4-trichlorobenzene solution of the polypropylene on the basis of tetramethylsilane.

As an exemplary catalyst in the preparation of the above-described syndiotactic polypropylene there/may be mentioned the catalyst system comprising a transition metal compound having an asymmetric ligand and an aluminoxane, as described in the foregoing literature by Ewen et al. It is also possible to use other different catalyst systems in the presence of which a polypropylene having a syndiotactic pentad fraction of 0.7 or more can be produced.

The exemplary preferred catalyst system for the preparation of the aforesaid syndiotactic polypropylene comprises a transition metal compound and an aluminoxane, as described in the foregoing literature. The transition metal compound includes isopropyl(cyclopentadienyl-1-fluorenyl)hafnium dihalogen, isopropyl(cyclopentadienyl-1-fluorenyl)zirconium dihalogen, and those transition metal compounds in which at least one of the halogen atoms is replaced by an alkyl group. As the aluminoxane may be cited compounds represented by the general formula

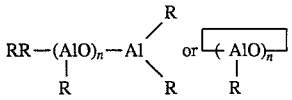

wherein R is a hydrocarbon residue of 1–3-carbon atoms. The compounds, in which R is a methyl group, i.e. methylaluminoxane, and n is 5 or more, preferably 10 or more, are particularly useful. The proportion of the aluminoxane used is 10 to 1,000,000 mole times, usually 50 to 5,000 mole times based on the foregoing transition metal compound. No particular restrictions are imposed on the polymerization conditions, and hence the solvent polymerization process using inert solvents, the bulk polymerization process in the substantial absence of inert solvents and the gas phase polymerization process may be used.

It is a common practice to carry out the polymerization at a temperature of −100° to 200° C. and a pressure of atmospheric to 100 kg/cm$^2$G. Temperatures of −100° to 100° C. and pressures of atmospheric to 50 kg/cm$^2$G are preferred.

The syndiotactic polypropylene thus obtained is generally narrow in molecular weight distribution so that it is suitable for preparing fibers. The preferred molecular weight is about 0.1–3.0 in terms of the intrinsic viscosity measured in its tetralin solution at 135° C. The syndiotacticity expressed as a syndiotactic pentad fraction is 0.7 or more, preferably 0.8 or more. Those of less than 0.7 do not give sufficient characteristics of crystalline polypropylene, so that the properties, such as strength, of the resulting fiber are unfavorably inferior.

In the present invention, it is feasible to use a composition consisting of at least 50 parts by weight of the above-described syndiotactic polypropylene and at most 50 parts by weight of an isotactic polypropylene as the fiber raw material. If the amount of an isotactic polypropylene is more than 50 parts by weight, the strength of the resulting fiber will unpreferably be insufficient. Preparation processes of isotactic polypropylenes are widely known, and hence they can be produced with ease by procedures known in the art.

The fiber of the present invention can be prepared by using a raw material composed mainly of a polypropylene having a syndiotactic pentad fraction of 0.7 or more, as described above. It has however been found to be advantageous to use either of the following two raw materials in order to obtain the composition having excellent extrudability and to make the extruded material capable of being stretched under various conditions and to have superb properties such as strength.

Specifically, one of the more preferred embodiments of the fiber of the present invention is a fiber with an average size of 10,000–0.1 denier formed by extruding a composition composed of a polypropylene (A) having a syndiotactic pentad fraction of 0.7 or more and a polypropylene (B) having a different molecular weight and a syndiotactic pentad fraction of 0.7 or more, and optionally stretching the resulting extruded composition, the value of common logarithms of the ratio of the intrinsic viscosity $\eta_2$ of the polypropylene (B) to the intrinsic viscosity $\eta_1$ of the polypropylene (A) [$\log(\eta_2/\eta_1)$], both measured in a tetralin solution at 135° C., being either more than 0.05 or less than −0.05, the weight ratio of the polypropylene (A) to the polypropylene (B) being in the range of 95:5–5:95.

The second preferred embodiment is a fiber with an average size of 10,000–0.1 denier formed by extruding a composition composed of a polypropylene (A) having a syndiotactic pentad fraction of 0.7 or more and an isotactic polypropylene (B) having a different molecular weight and optionally stretching the resulting extruded composition, the value of common logarithms of the ratio of the intrinsic viscosity $\eta_2$ of the polypropylene (B) to the intrinsic viscosity $\eta_1$ of the polypropylene (A) [$\log(\eta_2/\eta_1)$], both measured in a tetralin solution at 135° C., being either more than 0.05 or less than −0.05, the weight proportion of the polypropylene (A) and the polypropylene (B) being at least 50 parts for the polypropylene (A) at most 50 parts for the polypropylene (B).

In both of the above two embodiments, the molecular weights of the component (A) and the component (B) are around 0.4–3.0 in terms of the intrinsic viscosity as described above for the component of the larger molecular weight and around 0.1–2.5 for the component of the smaller molecular weight, in view of the extrudability, the stretching property, or the strength of the resulting fiber. It is necessary for the intrinsic viscosities $\eta_1$ and $\eta_2$ of the both components to have such a relationship that the $\log(\eta_2/\eta_1)$ is either more than 0.05 or less than −0.05. If the $\log(\eta_2/\eta_1)$ is between 0.05 and −0.05, the extrudability and the stretching property will be scarcely improved. A $\log(\eta_2/\eta_1)$ of more than 0.06 or less than −0.06 is more preferred.

No particular limitations are imposed on the mixing procedure of components (A) and (B). The components may be mixed in a mixer such as Henschel mixer in the form of powder or pellets and then granulated by an extruder, or may be mixed in a molten state using a roller, Banbury mixer, brabender, etc. Alternatively, the composition can also be obtained by first polymerizing a given amount of the monomer under the conditions to produce the plypropylene (A) and then polymerizing a further given amount of the monomer under other conditions to produce the polypropylene (B) having a different molecular weight from that of the polypropylene (A).

In the preparation of the fiber of the present invention, this raw material, with additives such as antioxidant added as required, after being granulated if necessary, is extruded into a fibrous form. There is no particular restriction for the apparatus of making the material fibrous. It is thus sufficient to use such an apparatus which is formed by equipping a conventional extruder with a die having a given number of nozzles of a given diameter suitable for making the material fibrous. In this case, since syndiotactic polypropylenes are comparatively slow in crystallizing speed, it is more preferable to use a nucleating agent or to devise means for cooling the extruded fiber.

The fiber thus extruded is then stretched, if necessary. No particular limitations are placed on the conditions of the stretching. For the raw material composed mainly of a syndiotactic polypropylene having a certain level of molecular weight, however, stretching is rather easy at relatively lower temperatures, as compared with isotactic polypropylenes. In some cases, it is preferable to stretch the raw material at a relatively low temperature and then at an elevated temperature. On the other hand, in the foregoing preferred embodiments of the present invention, — that is, when the compositions consisting of the polypropylenes (A) and (B) are used as the raw material, it is possible to stretch the raw material under substantially the same conditions as used for conventional isotactic polypropylenes. In conclusion, when compared with the case where the component (A) alone, i.e., the syndiotactic polypropylene having a certain level of molecular weight is rendered fibrous and stretched, the extruding conditions are broader and hence can be selected at will. The compositions in the both embodiments are excellent in this respect.

The present invention will be illustrated more specifically with reference to the following examples.

EXAMPLE 1

In the presence of 0.2 g of isopropyl(cyclopentadienyl-1-fluorenyl)zirconium dichloride and 30 g of methylaluminoxane(manufactured by TOSO AKUZO Corp.; polymerization degree=16.1), propylene was polymerized for 2 hours under the conditions of 3 kg/cm$^2$G and 20° C. in an autoclave with an inner volume of 200 liters. Here, the isopropyl(cyclopentadienyl-1-fluorenyl)-zirconium dichloride had been obtained by introducing lithium into isopropylcyclopentadienyl-1-fluorene synthesized in a conventional manner and reacting the resulting compound with zirconium tetrachloride, followed by recrystallization. Then, the polymerization reaction product was treated with methanol and methyl acetoacetate for deashing, washed with aqueous hydrochloric acid and filtered to obtain 5.6 kg of a syndiotactic polypropylene. This polypropylene had a syndiotactic pentad fraction of 0.935 according to the $^{13}$C-NMR spectrum analysis, an intrinsic viscosity of 1.45 as measured in a tetralin solution at 135° C., and an MW/MN of 2.2 as measured in 1,2,4-trichlorobenzene. Calcium stearate and 2,6-di-t-butylphenol were added to the polypropylene individually at a proportion of 10 to 10,000, and then talc at a proportion of 100 to 10,000. The resulting mixture was formed into granules, which were then spun into a fiber by a 40 mm extruder through a die with 14 nozzles at a temperature of 220° C. and a screw revolution of 64 rpm. The size of the resulting fiber was 370 D/14 filaments, while its maximum strength and the elongation were 480 g and 150%, respectively, in the tensile test. When stretched two-fold at 60° C., the fiber had a size of 210 D/14 filaments, a maxium strength of 560 g and an elongation of 40%. The two-fold stretched yarn had a flatly increased strength with increasing elongation and had no yield point.

COMPARATIVE EXAMPLE 1

A fiber was prepared in the same manner as in Example 1 except for using a conventional isotactic polypropylene having an isotactic pentad fraction of 0.980 according to the $^{13}$C-NMR spectrum analysis, an intrinsic viscosity of 1.52 as measured in a tetralin solution at 135° C., and an MW/MN of 4.8 as measured in 1,2,4-trichlorobenzene. The size of the fiber before stretching was 370 D/14 filaments, the maximum strength was 380 g, and the elongation was 520%. The two-fold stretched fiber had a size of 210 D/14 filaments, a maximum strength Of 450 g and an elongation of 120%. The presence of a yield point was clearly observed in the two-fold stretched yarn. The fiber in Example 1 had a higher strength, better luster and softer feeling by hand than the fiber in this Comparative Example.

EXAMPLE 2

A fiber was prepared in the same manner as in Example 1 except for using a mixture of 85 parts by weight of the syndiotactic polypropylene used in Example 1 and 15 parts by weight of the isotactic polypropylene used in Comparative Example 1 as the raw material. The fiber before stretching had a size of 370 D/14 filaments, a maximum strength of 420 g and an elongation of 140%, while the two-fold stretched fiber had a size of 210 D/14 filaments, a maximum strength of 490 g and an elongation of 41%.

EXAMPLE 3

Polymerization and post treatment were carried out in the same manner as in Example 1 except that the polymerization temperature and the polymerization time were altered to 0° C. and 6 hours, respectively, thereby obtaining a polymer (B) having an intrinsic viscosity ($\eta_2$) of 2.20, a syndiotactic pentad fraction of 0.915, and an MW/MN of 1.9. Ninety parts of the polymer (A) with an intrinsic viscosity ($\eta_1$) of 1.45 obtained in Example 1 were mixed with 10 parts of the polymer (B) with an intrinsic viscosity ($\eta_2$) of 2.20, to which the stabilizers used in Example 1 and talc were added individually at a proportion of 10 to 10,000 relative to the mixture. After being granulated, the resulting mixture was spun into a fiber by a 40 mm extruder through a die having 14 nozzles at a temperature of 220° C. and a screw revolution of 64 rpm. Here, the value of $\log(\eta_2/\eta_1)$ is 0.181. The size of the fiber obtained was 385 D/14 filaments, while the maximum strength and the elongation were 495 g and 185%, respectively, in the tensile test. This fiber was stretchable at a rate of 50 m/min. in the range of 60°–130° C. When stretched two-fold at 120° C., the fiber had a size of 220 D/14 filaments, a maximum strength of 580 g and an elongation of 38%.

On the contrary, in Example 1, i.e., in obtaining the stretched yarn by using solely the polymer having an intrinsic viscosity of 1.45, the stretching was conducted at 60° C. at a rate of 5 m/min. When stretched at a rate of 10 m/min. or more, the fiber was broken, and at 70° C. or above, the fiber could not be stretched.

EXAMPLE 4

Spinning was carried out in much the same manner as in Example 3 except for using as the raw material a mixture of 85 parts by weight of the syndiotactic polypropylene (A) with an intrinsic viscosity ($\eta_1$) of 1.45 obtained in Example 1 and 15 parts by weight of a commercially available isotactic polypropylene (B) (isotactic pentad fraction= 0.980, intrinsic viscosity ($\eta_2$)=2.07). Here, the value of $\log(\eta_2/\eta_1)$ was 0.154. The fiber before stretching had a size of 380 D/14 filaments, a maximum strength of 470 g and an elongation of 140%, while the two-fold stretched yarn had a size of 220 D/14 filaments, a maximum strength of 570 g and an elongation of 70%. This fiber was stretchable at a rate of 50 m/min. in the range of 60° C.–130° C.

EXAMPLE 5

Spinning was carried out in much the same manner as in Example 3 except for using as the raw material a mixture of 10 parts of the polymer (A) with an intrinsic viscosity ($\eta_1$) of 1.45 and 90 parts of the polymer (B) with an intrinsic viscosity ($\eta_2$ ) of 2.20. Here, the value of $\log(\eta_2/\eta_1)$ is 0.181. The fiber before stretching had a size of 380 D/14 filaments, a maximum strength of 510 g and an elongation of 210%, while the two-fold stretched fiber had a maximum strength of 620 g and an elongation of 70%. This fiber had a size of 220 D/14 filaments and was stretchable at a rate of 50 m/min. in the range of 60° C.–130° C.

We claim:

1. A fiber with an average size of 10,000–0.1 denier formed by extruding a raw material comprising a polypropylene having a syndiotactic pentad fraction of 0.7 or more.

2. The fiber according to claim 1 wherein the extruded material is stretched.

3. The fiber according to claim 1 or 2 wherein said raw material is a polypropylene having a syndiotactic pentad fraction of 0.7 or more.

4. The fiber according to claim 1 or 2 wherein said raw material is a composition comprising at least 50 parts by weight of a polypropylene having a syndiotactic pentad fraction of 0.7 or more and less than 50 parts by weight of an isotactic polypropylene.

5. The fiber according to claim 1 or 2 wherein said raw material is a composition comprising a polypropylene (A) having a syndiotactic pentad fraction of 0.7 or more and a polypropylene (B) having a different molecular weight and a syndiotactic pentad fraction of 0.7 or more, the value of common logarithms of the ratio of the intrinsic viscosity $\eta_2$ of the polypropylene (B) to the intrinsic viscosity $\eta_1$ of the polypropylene (A) [$\log(\eta_2/\eta_1)$], both measured in a tetralin solution at 135° C., being either more than 0.05 or less than −0.05, the weight ratio of the polypropylene (A) to the polypropylene (B) being in the range of 95:5–5:95.

6. The fiber according to claim 1 or 2 wherein said raw material is a composition comprising a polypropylene (A) having a syndiotactic pentad fraction of 0.7 or more and an isotactic polypropylene (B) having a different molecular weight, the value of common logarithms of the ratio of the intrinsic viscosity $\eta_2$ of the polypropylene (B) to the intrinsic viscosity $\eta_1$ of the polypropylene (A) $[\log(\eta_2/\eta_1)]$, both measured in a tetralin solution at 135° C., being either more than 0.05 or less than −0.05, the weight proportion of the polypropylene (A) and the polypropylene (B) being at least 50 parts for the polypropylene (A) and less than 50 parts for the polypropylene (B).

7. The fiber according to claim 1 or 2 wherein said raw material further comprises a copolymer of propylene and 20% or less of an olefin other than propylene.

8. The fiber according to claim 1 or 2 wherein said raw material further comprises a copolymer of propylene and 20% or less of at least one member selected from the group consisting of ethylene, butene-1, pentene-1, 4-methylpentene-1, hexene-1 and octene-1.

* * * * *